US007328466B1

(12) United States Patent
Bowen

(10) Patent No.: US 7,328,466 B1
(45) Date of Patent: Feb. 12, 2008

(54) RETRACTABLE SPLASH GUARD

(75) Inventor: Walter Lee Bowen, Washington, NC (US)

(73) Assignee: Kidkusion, Inc., Washington, NC (US)

( * ) Notice: Subject to any disclaimer, the term of this patent is extended or adjusted under 35 U.S.C. 154(b) by 317 days.

(21) Appl. No.: 11/254,080

(22) Filed: Oct. 19, 2005

(51) Int. Cl.
*A47K 3/08* (2006.01)
*E04F 10/06* (2006.01)

(52) U.S. Cl. ..... 4/558; 160/23.1

(58) Field of Classification Search ..... 4/558, 4/608; 160/23.1, 238, 313
See application file for complete search history.

(56) References Cited

U.S. PATENT DOCUMENTS 1,732,798 A * 10/1929 Falzer ..... 4/558
2,131,158 A 9/1938 Yardley
2,465,853 A * 3/1949 Dalton, Jr. ..... 4/558
4,286,343 A * 9/1981 Lampka ..... 4/596
4,916,764 A 4/1990 Meaden
5,007,120 A 4/1991 Annand
5,249,315 A 10/1993 Moylan
5,365,619 A 11/1994 Solomon
5,682,710 A * 11/1997 Davies et al. ..... 49/162
5,732,419 A 3/1998 Feist
5,785,105 A 7/1998 Crider
5,918,327 A 7/1999 Vance
6,195,817 B1 3/2001 Chilton
6,212,708 B1 4/2001 Mulaw
6,276,002 B1 8/2001 Oschmann
6,341,388 B1 1/2002 Roberts
6,470,511 B1 * 10/2002 Smale ..... 4/608
6,655,444 B2 12/2003 Goldenberg
6,701,543 B1 3/2004 Haq

* cited by examiner

*Primary Examiner*—Charles E. Phillips
(74) *Attorney, Agent, or Firm*—Coats & Bennett, P.L.L.C.

(57) ABSTRACT

A splash guard includes a shield that deploys in one direction, such as horizontally, but that also can be moved in a transverse direction, such as vertically, relative to a housing upon deployment. The retractable shield is used in a bathtub environment to help form a short retractable vertical wall across the open side of the bathtub to help return splashed water to the bathtub. Methods of using a retractable splash guard are also disclosed.

14 Claims, 5 Drawing Sheets

RETRACTABLE SPLASH GUARD

BACKGROUND OF THE INVENTION

The present invention is directed generally to a bathtub accessory, and more particularly to a retractable splash guard for containing water splashed from a bathtub.

Children, especially babies and young toddlers, frequently splash about while being bathed and/or take great pleasure in using squirting toys while bathing. Both activities cause water to be expelled from the bathtub that either drenches the parent overseeing the bathing or ends up on the floor, both of which are obviously undesirable. As such, various approaches to containing water in the bathtub have been proposed. One approach is simply to use a conventional shower curtain; however, this approach makes it almost impossible for the parent to reach into the bathtub to aid in the bathing process. Another approach is to use a short rigid wall that runs along the open side of the bathtub, such that shown in U.S. Pat. Nos. 5,249,315 and 5,365,619; however, these devices are cumbersome to use and consume relatively large amounts of space. Another approach is to attach an inclined plane to the side of the tub, with the plane extending outwardly away from the tub; however, this approach restricts access and is likewise quite space consuming.

Accordingly, there remains a need for alternative designs for splash guards, preferably designs that are space efficient for storage and/or allow a reasonable degree of access to the bathtub for the person outside the bathtub.

SUMMARY OF THE INVENTION

The present invention is directed to a retractable splash guard with a shield that deploys in one direction (e.g., horizontally), but that also can be moved in a generally transverse second direction (e.g., vertically) relative to a housing upon deployment. The retractable shield is used in a bathtub environment to help form a short retractable vertical wall across the open side of the bathtub to help return splashed water to the bathtub. Methods of using a retractable splash guard are also disclosed.

In one embodiment, the present invention provides a retractable splash guard comprising: a housing having a longitudinal axis extending in a first direction and a shaft mounted for rotation about the axis; a sleeve coupled to the shaft and moveable relative thereto along the axis; a flexible shield having first and second end sections and an intermediate section, the first end section anchored to the sleeve; the intermediate section having a height greater than the first end section by a first amount and greater than the second end section; the shield moveable in a second direction generally transverse to the axis between a retracted position and a deployed position; the shield coiled about the sleeve in the retracted position; the second end section and the intermediate section disposed distally from the sleeve in the second direction in the deployed position; and wherein the sleeve is moveable relative to the shaft along the axis by at least about the first amount in the deployed position. The sleeve is advantageously rotationally coupled to the shaft and the shaft is advantageously rotationally biased to urge the shield to retract. The shield may advantageously be transparent, or at least translucent, optionally with indicia visible on the shield in the deployed position. A mounting flange may be affixed to the second end portion of the shield, with the mounting flange having attachment means for attaching to a wall. Likewise, the housing may include means for mounting to a wall.

In another embodiment, the present invention provides a retractable splash guard comprising: a housing having a longitudinal axis extending in a first direction; a flexible shield having proximate and distal end sections relative to the housing and an intermediate section; the intermediate section having a height greater than the first end section by a first amount and greater than the second end section; the shield moveable in a second direction generally transverse to the axis between a retracted position and a deployed position; means for allowing the shield to play out from the housing in the second direction to a point where distal end section and the intermediate section are disposed distally from the housing, and, while in the deployed position, for allowing the proximate end section to move relative to the housing along the axis by at least about the first amount. The splash guard may further comprise means for rotationally biasing the shield to retracted position.

In another embodiment, a method of containing splashed water from escaping a bathtub comprises: providing a splash guard having a retractable flexible shield selectively deployable from a housing, the housing having a generally vertical longitudinal axis and a shaft mounted for rotation about the axis; the flexible shield horizontally moveable between a retracted position and a deployed position and having first and second end sections and an intermediate section; the intermediate section having a height greater than the first end section by a first amount and greater than the second end section; the splash guard having a sleeve coupled to the shaft and vertically moveable relative thereto along the axis; the first end section of the shield anchored to the sleeve; moving the shield horizontally from a retracted position wherein the shield is coiled about the sleeve to a deployed position wherein the second end section and the intermediate section are disposed distally from the sleeve; and sliding the sleeve relative to the shaft along the axis in a downward direction by a distance of at least about the first amount. The method may further comprise thereafter attaching the second end section of the shield to a wall and/or thereafter detaching the second end section of the shield from the wall and retracting the shield horizontally so that the shield reassumes the retracted position. The retracting the shield may comprise moving the sleeve in a direction opposite the first direction prior to coiling the intermediate section about the sleeve.

DETAILED DESCRIPTION OF THE INVENTION

Figure 1:
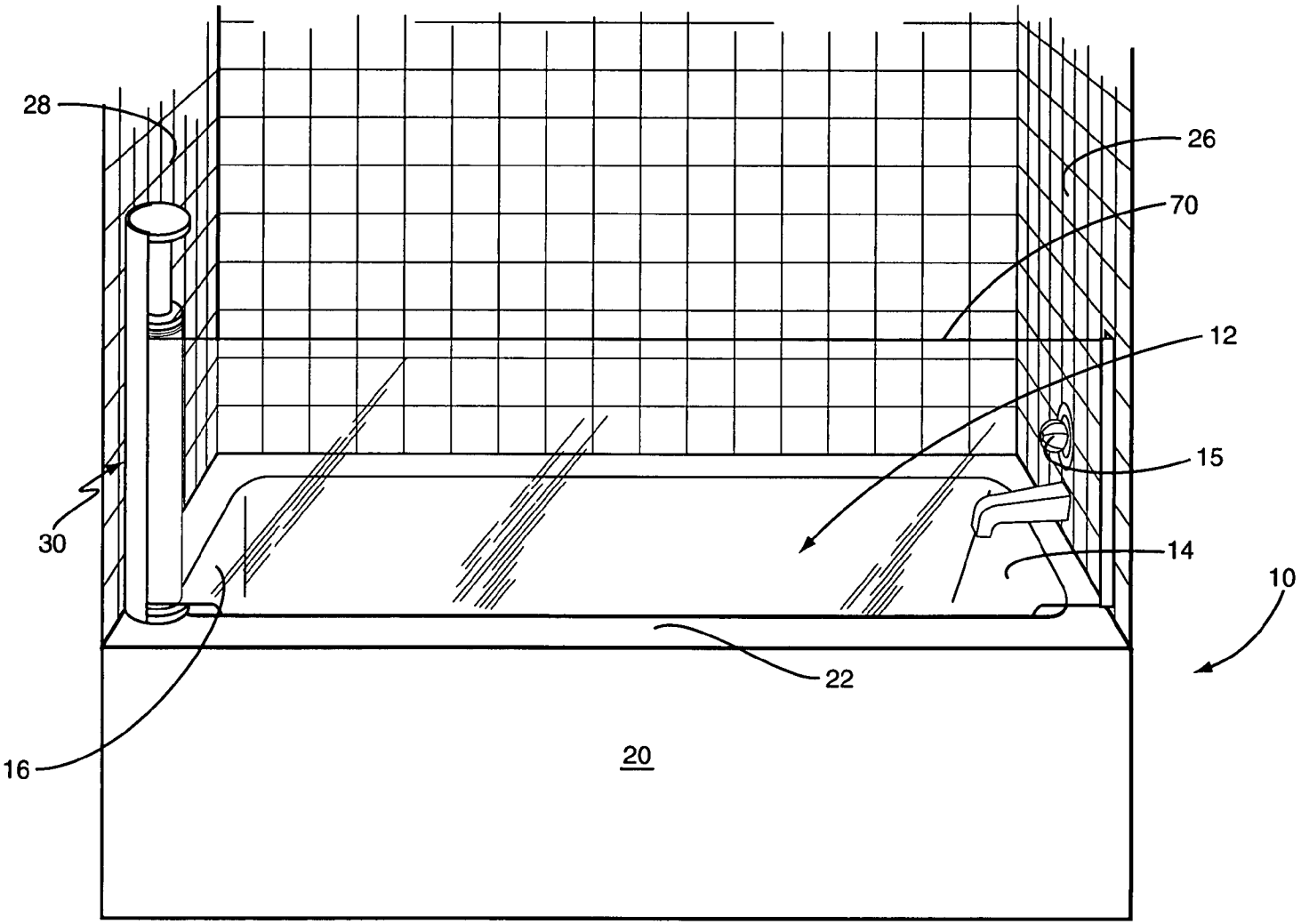
FIG. 1 shows one embodiment of the splash guard in accordance with the present invention installed in a bathtub environment.
Figure 2:
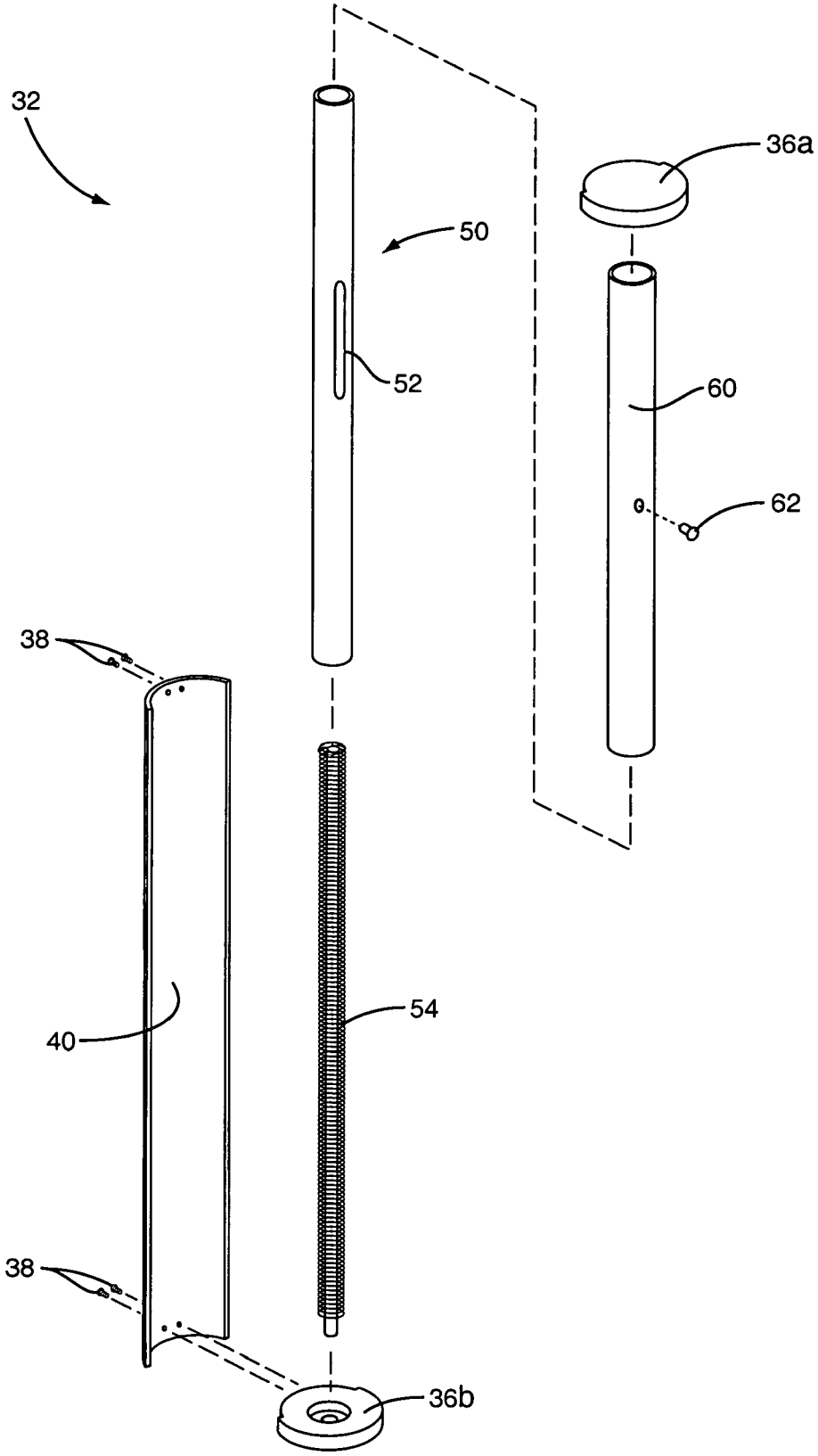
FIG. 2 shows an exploded view of the splash guard of FIG. 1 without the flexible shield.
Figure 3:
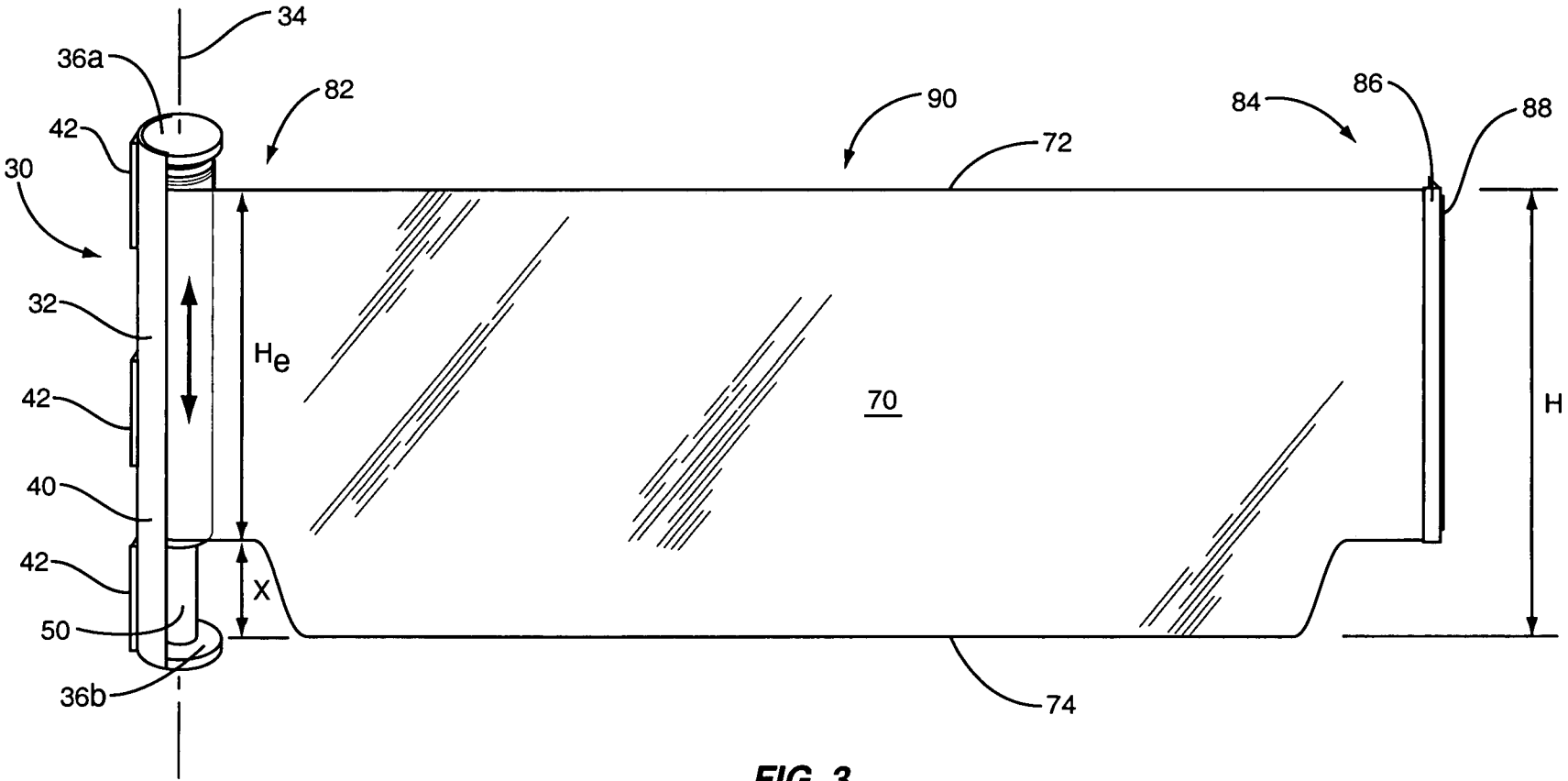
FIG. 3 shows the flexible shield connected to the sleeve.

The splash guard 30 of the present invention is intended to be used in a bathtub environment. As shown in FIG. 1, a bathtub 10 includes a pool or well 12 for holding water, with a front 14, a rear 16, and respective sides 18,20. The controls 15 for the bathtub 10, such as the faucet, drain, and control valve(s) are typically located toward the front of the bathtub 10. One of the sides 20 of the bathtub 10 is conventionally the side from which people enter and exit the bathtub 10, and is referred to herein as the access side 20 of the bathtub 10 for convenience. Typically, the bathtub 10 is surrounded on three sides by structural walls, including a front wall 26 and a rear wall 28, and a longer side wall opposite the access side 20. However, the access side 20 of the bathtub 10 is typically open, and the access side 20 conventionally has a relatively flat upper surface 22 that is fairly wide.

One embodiment of the splash guard of the present invention, generally indicated at 30 includes a housing 32, slidable sleeve 60, and a retractable shield 70. The housing 32 is intended to mount to one of the structural walls 28 proximate the bathtub 10, and the shield 70 is intended to deploy from, and retract back into, the housing 32. The slidable sleeve 60 connects the shield 70 to the housing 32 and allows the shield to move vertically relative to the housing 32, as described further below.

The housing 32 is generally elongate, extending along longitudinal axis 34. The housing 32 includes a longitudinal wall 40, end caps 36*a*,36*b*, and a shaft 50. The longitudinal wall 40 advantageously takes the form of a curved wall that extends approximately 180° around the axis 34, essentially being one half of a hollow cylinder. The end sections of the longitudinal wall 40 may have thickened and/or flattened sections for mounting the end caps 36*a*,36*b* if desired. The end caps 36*a*,36*b* are attached to the respective ends of the longitudinal wall 40, such as by screws 38 and extend generally perpendicular thereto. Other means of attaching the end caps 36*a*,36*b* may alternatively be used, such as snap fitting, glue, or the like. The end caps 36*a*,36*b* may have flattened sections and peripheral recesses, for mating with the longitudinal wall 40. In addition, the end caps 36*a*,36*b* may have central recesses for accepting the ends of the shaft 50. The shaft 50 typically takes the form of hollow cylinder, but this is not required in all embodiments. The shaft 50 extends between the end caps 36*a*,36*b*, along longitudinal axis 34, and is mounted so as to be rotationally coupled to the end caps 36*a*,36*b* for rotation about longitudinal axis 34.

The shaft 50 is advantageously rotationally biased, such as by an internal spring 54 anchored on one end to an endcap 36*a* and on the other end to the shaft 50, for reasons discussed further below. Spring 54 may take the form of a conventional extension spring aligned along the rotational axis 34, and secured at one end to the upper end cap 36*a* and at the other end to a cross pin extending laterally through the shaft 50. Of course, any variety of other means known in the art may alternatively be used to rotationally bias the shaft 50 if desired.

The sleeve 60 is slidably mounted on shaft 50 so as to be moveable in relation thereto along longitudinal axis 34. The sleeve 60 typically takes the form of a hollow cylindrical body, but this is not required in all embodiments. The sleeve 60 is coupled to shaft 50 so as to rotate therewith. To achieve this, the sleeve 60 may be coupled to shaft 50 via a guide pin 62 that extends through a longitudinal slot 52 in the middle section of shaft 50. This guide pin 62 may take many forms, but a simple screw/nut arrangement has been found to be effective. The guide pin 62 forces sleeve 60 to rotate with shaft 50, but allows sleeve 60 to move longitudinally along shaft 50 in a sliding motion.

The retractable shield 70 may advantageously take the form of flexible plastic sheet. The shield 70 has respective end sections 82,84 and an intermediate section 90. One end section 82 is anchored to the sleeve 60 such as by gluing, and the other end section 84 is selectively moveable toward and away from the housing 32. For ease of reference, the shield end section closest to the sleeve 60 is referred to herein as the reel section 82, and the shield end section farthest from the sleeve 60 is referred to herein as the latch section 84. The upper edge 72 of the shield 70 is advantageously relatively straight, but the lower edge 74 of the shield 70 is contoured so that the intermediate section 90 extends downward relative to the end sections 82,84. In particular, the lower edge 74 of the shield 70 in the intermediate section 90 extends beyond the lower edge 74 in the reel section 82 by an amount X. Stated another way, the height H of the intermediate section 90, as measured downward from the top edge 72 of the shield 70, is greater than the height $H_e$ of the reel section 82 by an amount X. While the intermediate section 90 may advantageously also be taller than the latch section 84 by X, such is not required in all embodiments. The lower edge 74 preferably smoothly transitions from the end sections 82,84 to the intermediate section 90, but this is not required in all embodiments, and the transition may be step-like if desired. The majority of the shield 70, and at least the intermediate section 90, is advantageously transparent, although translucence may be suitable for some applications. In addition, the intermediate section 90 may have suitable indicia printed thereon if desired, such as animals, cartoon characters, the ocean, and the like. It is intended that the shield 70 will, when deployed, reach only a limited distance above the top surface 22 of the access side 20 of bathtub 10, so that a parent may easily reach over the shield 70 to reach a child bathing in the tub. As such, it is expected that the maximum height H of the shield 70 will be in the range of twelve to twenty-four inches, advantageously sixteen to eighteen inches.

The latch section 84 of the shield 70 advantageously includes a flange 86 attached thereto. This flange 86 provides a convenient means for attaching the latch section 84 to the corresponding structural wall 26 and somewhat structurally supports the latch section 84. For the embodiment shown in the FIG. 1, the flange 86 advantageously has a L-shaped cross-section, with suitable hook and loop fastener pads 88 on one side. A portion of the flange 86 may engage the housing's longitudinal wall 40 to prevent over-retraction of the shield 70, as described further below.

Figure 4:
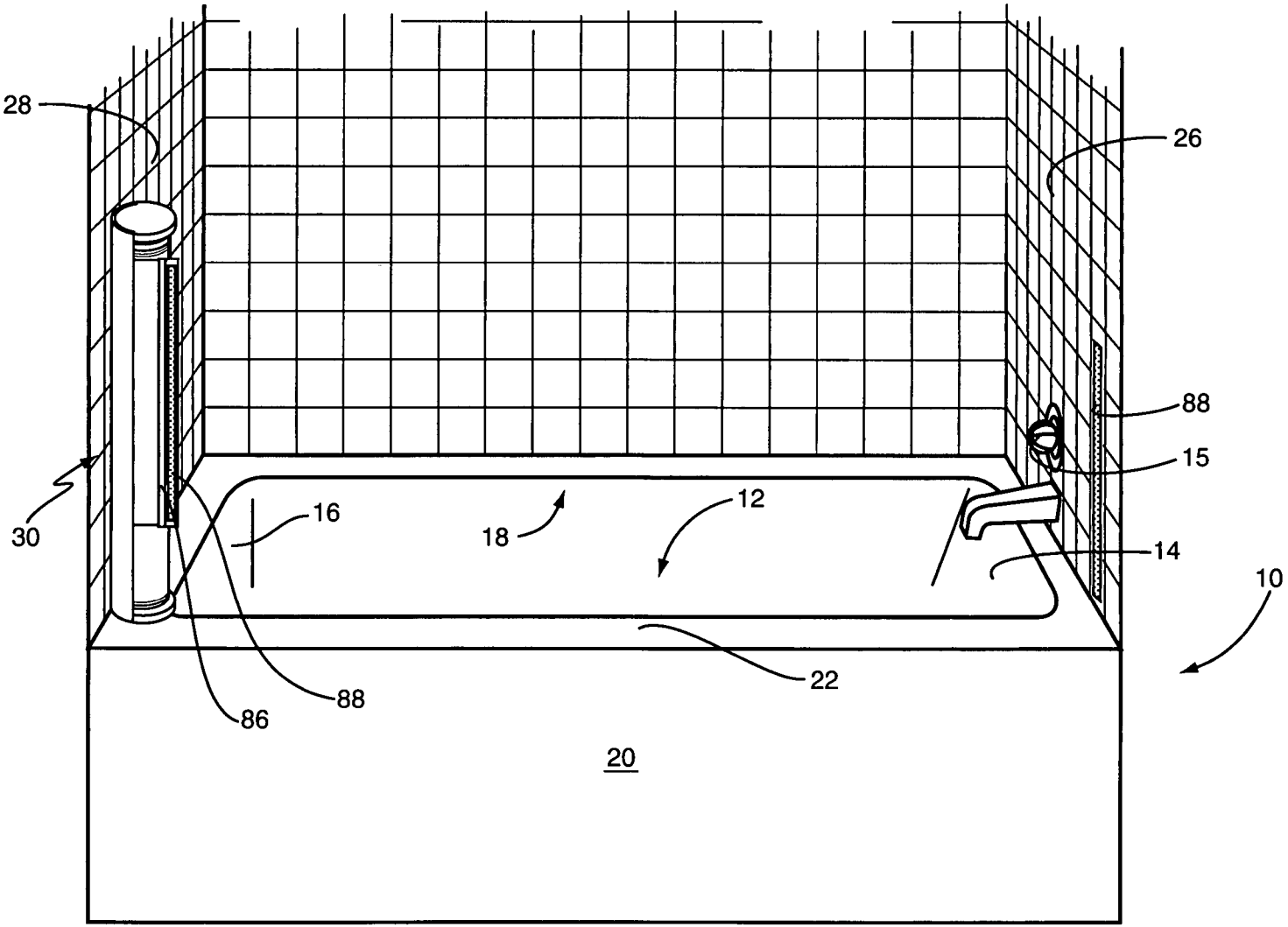
FIG. 4 shows the splash guard of FIG. 1 in the retracted position.
Figure 5:
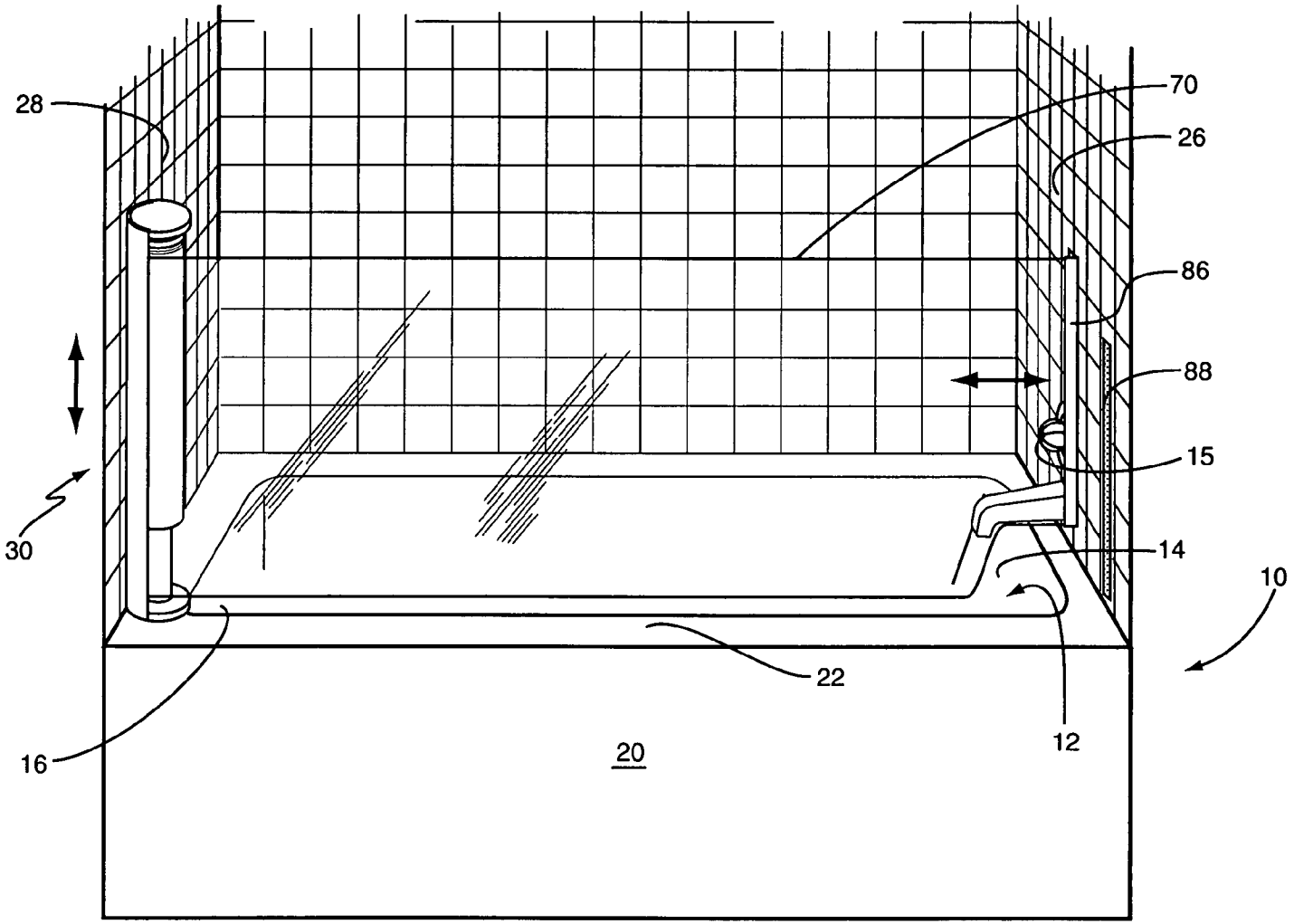
FIG. 5 shows the splash guard of FIG. 1 in a deployed position, but not secured to both structural walls, and with the sleeve in the upward position.

As indicated above, the shield 70 is moveable between a retracted position (FIG. 4) and a deployed position (FIGS. 1 and 5). In the retracted position, the shield 70 is wound about the sleeve 60 in a coil fashion. The shield 70 is moved to the deployed position by simply pulling on the flange 86 or the latch section 84 horizontally away from the housing 32. This pulling action causes the sleeve 60 to impart a rotational force on the shaft 50, thereby overcoming the retraction bias on the shaft 50 (if present) and allowing the shield 70 to play out. See FIG. 5. At full deployment, the majority of the shield 70 is disposed distally from the housing 32, including the intermediate section 90 and the latch section 84, advantageously with only the end of the reel section 82 (anchored to the sleeve 60) still disposed proximate the housing 32. Of course, the shield 70 may be deployed less than fully, but it is advantageous if the shield 70 is sized so that the intermediate section 90 substantially matches the "length" of the tub's well along the access side 20.

To use the splash guard 30, the housing 32 is mounted to the structural wall 28 near the rear 16 of bathtub 10. Advantageously, this mounting is achieved via suitable adhesively backed hook and loop fastener sections 42 that engage the longitudinal wall 40 of the housing 32 and the structural wall 28. The housing 32 should be mounted so that the open portion of the housing 32 is oriented generally along the long access side 20 of bathtub 10, toward the opposing structural wall 26. When mounted, the housing 32 is vertically oriented, with axis 34 running generally perpendicular to the theoretical plane defined by the top surface 22 of the tub's access side 20. The latch section 84 of the shield 70 is then pulled horizontally across the access side 20 of the bathtub 10 and attached to the structural wall 26 proximate the bathtub's front 14. Prior to attaching the latch section 84 to the structural wall 26, it is possible that the lower edge 74 of the shield 70 in the intermediate section 90 is level with the top 22 of the access side 20 of bathtub 10. Such a situation is undesirable, as water may escape the bathtub 10 in any gaps formed between the two. Accordingly, the shield 70 is lowered into position. Compare FIG. 5 to FIG. 1. To do this, the sleeve 60 is slid downward relative to the shaft 50 by an amount equal to distance X, the distance the intermediate section 90 extends downward beyond the lower edge 74 of the reel section 82. The "extra" lower portion of the shield 70 is thereby placed against the inner wall of the bathtub 10, below the level of the access side's upper surface 22, and the lower edge 74 of the reel section 82 is brought into abutment with the access side's upper surface 22. Thus, the shield 70 effectively has an integral flap that reaches down into the tub's well 12. See FIG. 1. In order to maximize this effect, the attachment of the latch section 84 to the structural wall 26 should be low enough that the lower edge 74 of the latch section 84 abuts against the access side's upper surface 22.

To retract the shield 70, the latch section 84 is detached from the structural wall 26. With the latch section 84 in one hand, the user raises the sleeve 60 to is upper position by sliding the sleeve 60 relative to the shaft 50. The shield 70 is then rewound on the sleeve 60. In embodiments where the shaft 50 is rotationally biased to retract the shield 70, the user simply moves the latch section 84 back toward the housing 32, and the rotational force on the shaft 50 causes the sleeve 60 to rotate, taking up the shield 70. Note that the flange 86 advantageously engages the housing 32 when retraction is complete, thereby preventing over-retraction. The shield 70 may then be left in this storage position between uses.

The housing 32 may be formed of any suitable material, such as PVC, ABS, or the like. The shield 70 may be made from any suitable flexible material, such as 0.010 inch thick transparent vinyl or the like.

The discussion above has assumed that the shaft 50 is spring biased to urge the shield 70 to the retracted position. However, this is not required in all embodiments, and the shield 70 may be manually rewound in some embodiments, either directly or via suitable rewind means such as crank or the like. The discussion above has also assumed that the housing 32 includes a longitudinal wall 40, so as to provide convenient mounting points and to protect the inner workings of the device. However, a longitudinal wall 40 is not required in all embodiments; for example the housing 32 may be mounted at the endcaps 36*a*,36*b*, essentially leaving the shaft 50 and sleeve 60 exposed (ignoring the shield 70), without departing from the present inventive concept. Alternatively, in some embodiments, the longitudinal wall 40 may mostly circumferentially enclose the sleeve 60, leaving only a relatively narrow slit for passage of the shield 70. Further, it should be noted that other means known in the art, such as screws and eyelet openings, suction cups, or the like, may be used to attach the housing 32 and latch section 84 of the shield 70 to their respective structural walls 28,26, rather than adhesively backed hook and loop fastener patches 42,88, if desired.

Further, the description above has assumed that the housing 32 is mounted to rear structural wall 28 and the latch section 84 is moved toward the front structural wall 26 in order to deploy the shield 70. However, this relationship may be reversed in some embodiments, such that the housing 32 is mounted to the front structural wall 26 and the latch section 84 moved toward the rear structural wall 28 in order to deploy the shield 70.

The present invention may, of course, be carried out in other specific ways than those herein set forth without departing from the essential characteristics of the invention. The present embodiments are, therefore, to be considered in all respects as illustrative and not restrictive, and all changes coming within the meaning and equivalency range of the appended claims are intended to be embraced therein.

What is claimed is:

1. A retractable splash guard, comprising:

a housing having a longitudinal axis extending in a first direction and a shaft mounted for rotation about said axis;

a sleeve coupled to said shaft and moveable relative thereto along said axis;

a flexible shield having first and second end sections and an intermediate section, said first end section anchored to said sleeve; said shield moveable in a second direction generally transverse to said axis between a retracted position and a deployed position;

said intermediate section having a height greater than said first end section by a first amount and greater than said second end section;

said shield coiled about said sleeve in said retracted position;

said second end section and said intermediate section disposed distally from said sleeve in said second direction in said deployed position; and wherein said sleeve is moveable relative to said shaft along said axis by at least about said first amount in said deployed position.

2. The splash guard of claim 1 wherein said sleeve is rotationally coupled to said shaft.

3. The splash guard of claim 2 wherein said shaft is rotationally biased to urge said shield to retract.

4. The splash guard of claim 1 wherein said shield is translucent or transparent.

5. The splash guard of claim 1 further comprising indicia visible on said shield in said deployed position.

6. The splash guard of claim 1 further comprising a mounting flange affixed to said second end portion of said shield, said mounting flange having attachment means for attaching to a wall.

7. The splash guard of claim 1 wherein said housing includes means for mounting to a wall.

8. The splash guard of claim 1:

wherein said sleeve is rotationally coupled to said shaft and said shaft is rotationally biased to urge said shield to retract;

wherein said shield is translucent or transparent; and further comprising a mounting flange affixed to said second end portion of said shield, said mounting flange having attachment means for attaching to a wall.

9. A retractable splash guard, comprising:

a housing having a longitudinal axis extending in a first direction;

a flexible shield having proximate and distal end sections relative to said housing and an intermediate section; said intermediate section having a height greater than said proximate end section by a first amount and greater than said distal end section; said shield moveable in a second direction generally transverse to said axis between a retracted position and a deployed position; and means for allowing said shield to play out from said housing in said second direction to a point where said distal end section and said intermediate section are disposed distally from said housing, and, while in said deployed position, for allowing said proximate end section to move relative to said housing along said axis by at least about said first amount.

10. The splash guard of claim 8 further comprising means for rotationally biasing said shield to retracted position.

11. A method of containing splashed fluid from escaping a bathtub, comprising:

providing a splash guard having a retractable flexible shield selectively deployable from a housing, said housing having a generally vertical longitudinal axis and a shaft mounted for rotation about said axis; said flexible shield horizontally moveable between a retracted position and a deployed position and having first and second end sections and an intermediate section; said intermediate section having a height greater than said first end section by a first amount and greater than said second end section; said splash guard having a sleeve coupled to said shaft and vertically moveable relative thereto along said axis; said first end section of said shield anchored to said sleeve;

moving said shield horizontally from a retracted position wherein said shield is coiled about said sleeve to a deployed position wherein said second end section and said intermediate section are disposed distally from said sleeve; and sliding said sleeve relative to said shaft along said axis in a downward direction by a distance of at least about said first amount.

12. The method of claim 11 further comprising thereafter attaching said second end section of said shield to a wall.

13. The method of claim 12 further comprising thereafter detaching said second end section of said shield from said wall and retracting said shield horizontally so that said shield reassumes said retracted position.

14. The method of claim 13 wherein said retracting said shield comprises moving said sleeve in a direction opposite said first direction prior to coiling said intermediate section about said sleeve.

* * * * *